United States Patent [19]

Steinbach

[11] Patent Number: 4,899,565

[45] Date of Patent: Feb. 13, 1990

[54] SQUARE SHAPED AXIAL SPLIT PIN TUMBLER LOCK

[75] Inventor: Robert Steinbach, Glendale Heights, Ill.

[73] Assignee: Chicago Lock Company, Chicago, Ill.

[21] Appl. No.: 400,781

[22] Filed: Aug. 30, 1989

[51] Int. Cl.[4] ..... E05B 27/08

[52] U.S. Cl. ..... 70/491; 70/404; 70/409

[58] Field of Search ..... 70/491, 402–404, 70/407, 409, 420, 347, 454

[56] References Cited

U.S. PATENT DOCUMENTS

| | | | |
|---|---|---|---|
| 1,458,520 | 6/1923 | Castell | 70/404 |
| 3,267,706 | 8/1966 | Kerr | 70/491 |
| 3,681,955 | 8/1972 | Sturgeon | 70/491 |
| 4,041,739 | 8/1977 | Mercurio | 70/491 |
| 4,100,777 | 7/1978 | Fredon | 70/491 |
| 4,191,036 | 3/1980 | Steinbach | 70/491 |

*Primary Examiner*—Lloyd A. Gall

*Attorney, Agent, or Firm*—Basil E. Demeur; Robert E. Knechtel; Alan B. Samlan

[57] ABSTRACT

An improved axial split pin tumbler type lock is provided. The improvement consists in providing a cylinder having a lock head formed with a square-shaped keyhole defining a front face on the lock head, and a three-part plug assembly inserted in the cylinder. One of the three-part plug assemblies consists of a cylinder head having a forward end provided with a square-shaped cut-out section formed therein, the square cut-out section radially traversing the tumbler bores formed therein. A tubular key is provided having an inner circular core, and an outer square-shaped face adapted to matingly engage within the square-shaped keyhole in the lock head and the square-shaped cut-out section in the cylindrical head portion. The square-shaped front face of the lock head includes a series of thickened face sections alternating with a series of thinner face sections. The driver tumbler positioned in the bores of the cylindrical head ride immediately beneath the square-shaped front face of the lock head such that the tumblers are at least partially shielded from manipulation by a lock pick by the thickened sections of the front face thereby to render the lock more pick resistant.

6 Claims, 2 Drawing Sheets

SQUARE SHAPED AXIAL SPLIT PIN TUMBLER LOCK

BACKGROUND OF THE INVENTION

The present invention relates to an improved form of an axial split-pin tumbler type lock and key combination. Heretofore, various types of axial split-pin tumbler-type locks have been devised, the differences from one to the other relating to attempts to render the lock more pick resistant.

For example, a tamper proof axial split-pin tumbler-type lock is disclosed in U.S. Pat. No. 3,541,819, which is directed to a lock constructed to induce a "false picking" which will not operate the lock. Another example of an axial split-pin tumbler-type lock is disclosed in U.S. Pat. No. 3,729,964, which employs a plurality of keys for controlling operation of the lock.

Similarly, Pat. No. 3,916,657, is again directed to an axial split-pin tumbler-type lock which is designed to operate only with a series of keys in a particular successive order thereby to render any picking operation more difficult. A first key operates to rotate both parts of a plug assembly conjointly, while the second key operates to rotate only one of the two parts, the other part being rotated to an inoperative position in which the lock cannot be picked directly. It is therefore necessary that both keys be utilized to operate the lock.

While it is known that various of the prior art axial split-pin tumbler-type locks have been devised and have achieved varying degrees of success in terms of being pick resistant, it is known that, ultimately, any lock may be picked. The goal is therefore to improve upon such types of locks in order to render the picking operation more difficult, and especially more time consuming. Insofar as picking operations are concerned, it is well-known that if one has access to the driver tumblers, especially in an axial split-pin tumbler-type lock, one can then apply a picking tool in order to move the tumblers to a point of the shear plane of the lock parts, and once that is determined, and if all tumblers are moved to the proper shear plane position, the lock may opened. Hence, the essence of a picking tool is to have access to the driver tumblers, usually from the front face of the lock.

The lock of the present invention is intended as an improvement over commonly known axially split-pin tumbler-type locks which provides an alternate means of shielding the driver tumblers from access by a picking tool via the front face of the lock.

OBJECTS AND ADVANTAGES

It is therefore the principal object of the present invention to provide an improved axial split pin tumbler type lock generally constructed in the same manner as other axial split-pin tumbler-type locks, but incorporating a front face of the lock which includes a square cut-out section, which operates in combination with a square-shaped key presenting a square-shaped outer face, and inner circular core. Throughout the specification, what is meant by "square" with reference to the key, lock head and cylindrical head portion, is "substantially square". The cylinder head of the lock is similarly accommodated with a square cut-out section in order to accommodate the insertion of the key therein in order to operate the lock.

In conjunction with the foregoing object, it is yet a further object of the present invention to provide an improved axial split-pin tumbler-type lock of the type described wherein the square-shaped front face of the lock head necessarily presents a series of thickened sections alternating with a series of thinner sections, the inner face of the lock head providing a riding surface for the driver tumblers as the lock plug is rotated. The driver tumbler, riding on a tubular ledge beneath the square-shaped front face of the lock will therefore be alternately relatively shielded from access to a lock pick as the same ride under the thickened sections of the lock front face.

In conjunction with the foregoing objects, it is a further object of the present invention to provide an axial split pin tumbler type lock of the type described, wherein the lock cylinder further includes an elongate slot formed along a portion of the interior wall thereof, and the sleeve member is provided with an upstanding flange formed along the upper face thereof, the upstanding flange adapted for mating engagement with the slot thereby to secure the sleeve member against rotational movement when positioned within the lock cylinder in order to allow the operating part to rotate in response to manipulation by a proper key while the sleeve member remains fixed against rotation.

Further features of the invention pertain to the particular arrangement of the parts whereby the above-outlined and additional operating features thereof are attained.

The invention, both as to its organization and method of operation, together with further objects and advantages thereof will best be understood by reference to the following specification taken in conjunction with the accompanying drawings.

SUMMARY OF THE INVENTION

In summary, the present invention is directed to an improved axial split-pin tumbler-type lock, which is adapted and constructed in order to increase the relative pick resistance of the lock. More specifically, the lock as constructed in accordance with the present invention renders access to the driver tumblers more difficult with a picking tool in order to increase the pick resistance thereof.

Constructionally, the axial split pin tumbler type lock of the present invention includes a lock cylinder which includes a three-part plug assembly inserted therein. The lock cylinder is provided with a front face which has a square-shaped keyhole formed therein, the inner face of the keyhole providing a riding surface for the driver tumblers there against. The three-part plug assembly consists of a lock shaft which carries a cylindrical head thereon, and a sleeve member which mounts onto the lock shaft in touching engagement with the cylinder head. The three-plug assembly fits within the lock cylinder in a manner commonly known with respect to other axial split-pin tumbler-type locks.

The lock of the present invention is further provided with a cylindrical head which similarly includes a square-shaped cut-out section formed in the forward end thereof, the square cut-out section radially traversing the tumbler bores formed therein. Driver tumblers are positioned in the tumbler bores of the cylinder head and are designed and adapted to ride on the inner face of the lock head. The square-shaped configuration of the keyhole defines a front face on the locking head which includes a series of thickened face sections alternating with a series of thinner face sections. Hence, the driver tumblers located in the cylindrical head bores, as they ride along the riding surface of the inner face of the lock head, will be shielded from access through the front face of the lock as the same ride under the thickened sections of the tumbler ledge, and will be slightly more greatly exposed as the same ride through the thinner face sections. In this manner, a lock pick has a greater degree of difficulty in maintaining any positive pressure against a driver tumbler as the same ride under thickened sections since the area of the tumbler head presented for touching contact with a lock pick is greatly reduced when the same ride under thickened sections of the front face. In this manner, pick resistance is greatly increased either due to the difficulty of providing a proper picking tool which could pick the lock, or in the alternative and additionally, by rendering the picking operation much more time consuming.

DETAILED DESCRIPTION OF DRAWINGS

Figures 1, 2, 3:
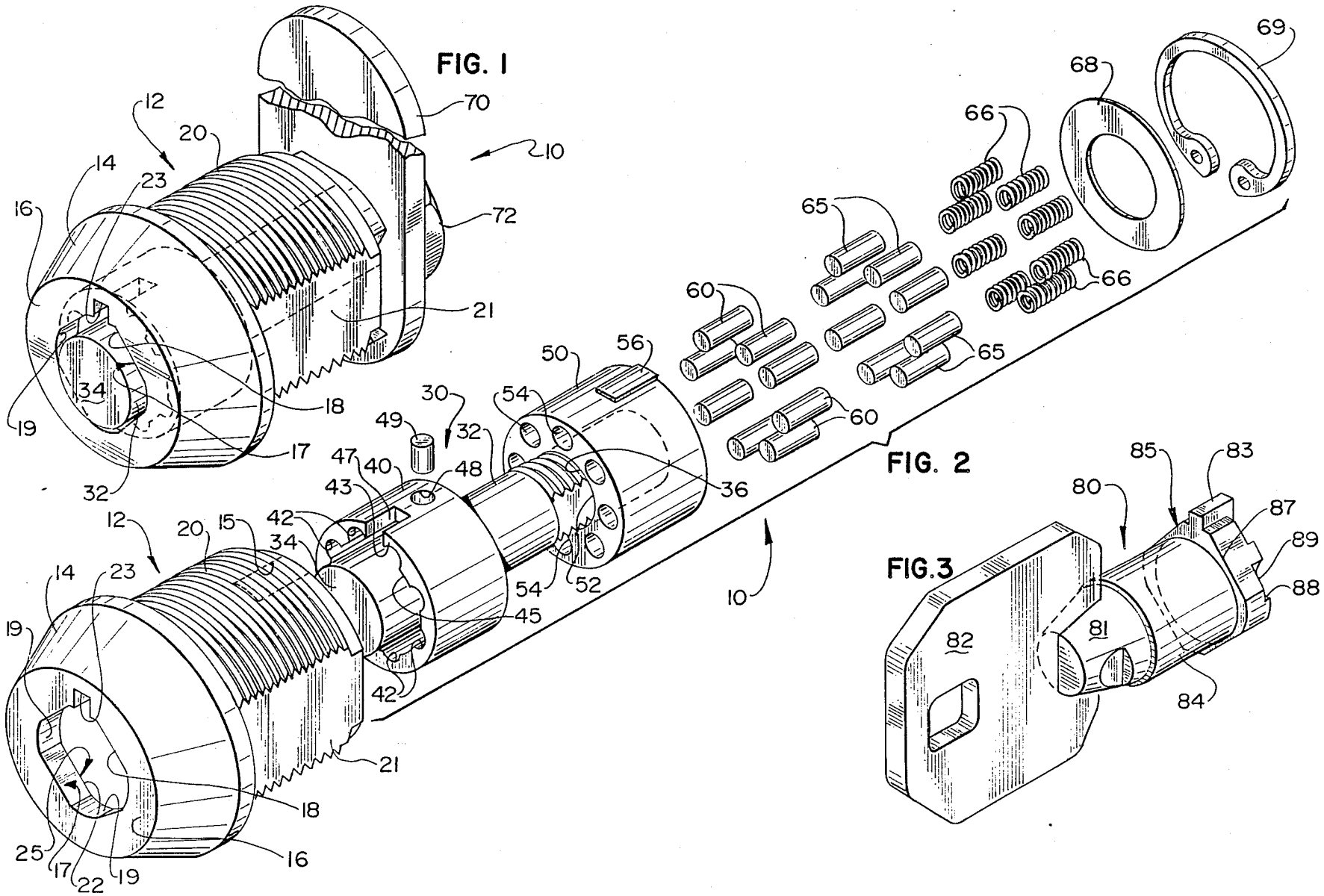
FIG. 1 is a perspective view, partly broken away, showing the improved axial split-pin tumbler-type lock assembly as a completed assembly, of the present invention.
FIG. 2 is an exploded view showing the relative positioning of the component parts of the axial split-pin tumbler-type lock assembly of the present invention including the lock cylinder, the three-part plug assembly, the tumblers, springs, and retaining rings located at the rear end of the lock.
FIG. 3 is a perspective view showing the configuration of the specially designed key which operates in combination with the lock assembly of the present invention.

As illustrated in FIGS. 1 and 2 of the drawings, the axial split-pin tumbler-type lock assembly 10 of the present invention is illustrated. The lock assembly 10 is shown to be formed by a lock cylinder 12 which is provided with a frusto conical head 14 at the front portion thereof, which forms a front face 16 containing a square-shaped keyhole 17 formed therein. The square-shaped keyhole 17 includes a series of four thickened sections 18, and four thinner sections 19. The lock cylinder 12 includes a threaded body 20 adjacent the rear portion thereof, and a pair of flats 21 located on opposed sides of the lock cylinder 12. The square-shaped keyhole 17 is also provided with a key notch 23 for a purpose to be more fully described hereinafter.

As is illustrated in FIGS. 1, 2, 5, and 6 of the drawings, the square-shaped keyhole 17 is actually provided with rounded corner sections forming the thinner sections 19 (see FIG. 5 for example), which together with the thickened sections 18 combine to form an important part of the present invention.

The axial split pin tumbler type lock 10 of the present invention is also shown to include a three-part plug assembly 30 formed by a lock shaft 32 which has a forward end terminating in a guide post 34 and a threaded rear portion 36. Adjacent the guide post 34 and spaced slightly rearwardly therefrom is a cylindrical head 40 which is fixedly secured to the lock shaft 32. As is well-known in the art, the cylindrical head 40 is provided with a plurality of tumbler bores 42 in which are positioned a plurality of driver tumblers 60. The forward portion 43 of the cylindrical head 40 is provided with a square-shaped cut-out section 45 which radially traverses the tumbler bores 42. The cylindrical head 40 is further provided with a key notch 47 and a pin receiving aperture 48.

As is generally known in the art, the cylindrical head 40 is usually friction fitted to the lock shaft 32, and is secured in position by means of a pin 49 which is inserted into the pin receiving aperture 48 and into a corresponding aperture 33 formed in the lock shaft 32. This constitutes the rotating part of the plug assembly 30 once a proper key is inserted in the lock and manipulated.

Adjacent the rear portion of the lock shaft 32 is positioned a sleeve member 50 which is centrally bored as at 52 such that the same may be slipped onto the lock shaft 32. The body portion of the sleeve member 50 is provided with a plurality of tumbler bores 54 in which follower tumblers 65 are located when the lock assembly 10 is fully assembled. The sleeve member 50 is further provided with an orienting flange 56 which, during assembly, is seated into a corresponding slot 15 (FIG. 2) formed on the interior cylindrical wall of the lock cylinder 12. It will therefore be appreciated that the sleeve member 50 constitutes the non-rotating part of the plug assembly 30 in view of the fact that the orienting flange 56 is positively secured against rotation when the same is seated in the slot 15 located in the interior surface of the lock cylinder 12. The rotating part of the plug assembly 30 therefore constitutes the cylindrical head 40 and lock shaft 32, while the non-rotating part of the plug assembly 30 constitutes the sleeve member 50.

The assembly is completed by inserting tumbler springs 66 into the tumbler bores 54, which are held in position by means of a flat washer 68 which in turn is held in position by a split ring 69 which is positioned over the threaded rear portion 36 of the lock shaft 32, and fits within a ring groove 63 in the rear portion of the lock cylinder 12. The use of flat washer 68 and split ring 69 may be altered and obviated in those instances where the sleeve member 50 is bored from the forward end to create tumbler bores 54 and leaving a rear wall on the sleeve member 50, as presently employed on such type of axial split pin tumbler type locks. In such a construction, the sleeve member 50 and lock cylinder 12 are held in position by a pin driven through an aperture in the sleeve member and lock cylinder respectfully. The method of positively orienting the sleeve member to the lock cylinder is not considered critical to the present invention, other than it is important to lock the sleeve member relative to the lock cylinder as indicated above.

The assembly is completed by providing a locking bolt 70 which is fitted over the threaded rear portion 36 of the lock shaft 32, the entire assembly being retained in a secured position by means of a threaded nut 72 (see FIG. 1).

As depicted in FIGS. 1 and 2 of the drawings, when the axial split-pin tumbler-type lock assembly 10 of the present invention is fully assembled, the guide post portion 34 of the lock shaft 32 is positioned within the square-shaped keyhole 17 formed in the front face of the frusto-conical head 14 and provides a bearing surface for the key 80 in manner to be described more fully hereinafter.

The key 80 is of an overall conventional structure which includes a body 81 connected to a wing-type torque-applying or manipulating handle 82. The body 81 includes a cylindrical tubular shank 84 having an inside circular configuration and a diameter slightly greater than the diameter of the guide post 34. The key 80 of the present invention is shown to further include a key seat 85 which has an overall substantially square-shaped outer configuration as indicated at 87 (see FIGS. 3 and 4 of the drawings), the square-shaped configuration 87 of the key seat 85 having a slightly smaller overall shape than that square-shaped keyhole 17 and square-shaped cut-out section 45 of the cylindrical head 40.

As is commonly known in the prior art, the key 80 is shown to further include a key flange 83 which is provided on the key seat 85 for the purpose of properly orienting the key 80 relative to the keyhole 17, and the cylindrical head 40. It would be appreciated that the key flange 83 is designed to seat within the key notch 23 of the square-shaped keyhole 17, and to also seat within the key notch 47 of the cylindrical head 40. The provision of a key flange for seatment within a key notch is well-known in the art, and is not deemed to be particularly the essence of the present invention, other than that structure properly orients the key with respect to the lock for the purpose of permitting the grooves 88 and bittings 89 to properly seat relative to the driver tumblers 60 which are contained within the cylindrical head 40.

Figure 4:
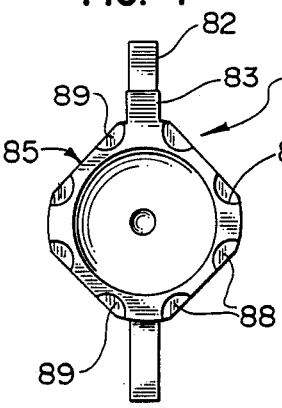
FIG. 4 is a front elevational view showing the configuration of the specially designed key operating in conjunction with the lock of the present invention.

It will also be observed from FIG. 4 of the drawings that the key seat 85 is provided with a series of arcuate grooves 88 which extend longitudinally from the outer end of the shank 84 and terminate in bittings or shoulders 89.

Figure 7:
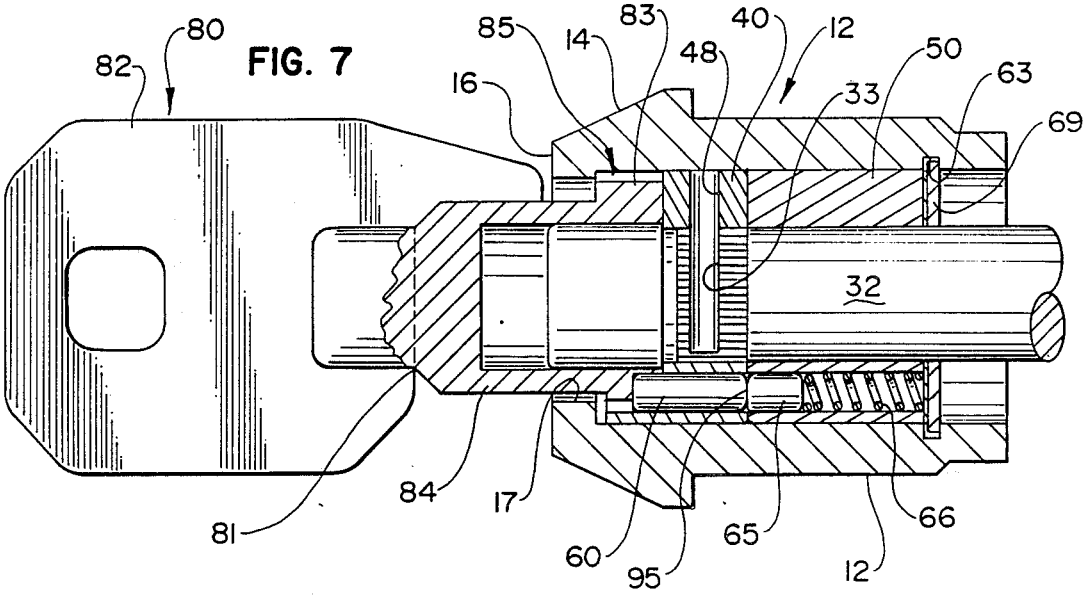
FIG. 7 is a side elevational view, in cross-section, taken in direction of the arrows along the lines 7—7 of FIG. 5 illustrating the positioning of the special key within the square-shaped front face of the lock cylinder and into the square-shaped section of the cylindrical head.

It will be appreciated that the key 80 of the present invention is designed and constructed such that the circular configuration of the cylindrical shank 84 is designed to seat over the circular guide post 34 of the lock shaft 32, while the square-shaped key seat 85 is designed to be inserted within the confines of the square-shaped keyhole 17 and into the square-shaped cut-out section 45 of the cylindrical head 40. The bittings 89 will then contact the heads of the driver tumblers 60 and, as is well known in the art, assuming that the proper key is utilized, the driver tumblers 60 will drive the follower tumblers 65 until the respective tumblers reach the shear line 95 (see FIG. 7) of the lock 10. When this position is achieved, the rotating part of the lock consisting of the cylindrical head 40 as connected to the lock shaft 32 is permitted rotational movement relative to the non-rotating part consisting of the sleeve member 50, the rotational movement thereby causing a concomitant rotation of the locking bolt 70 into either its locked or unlocked position. Hence, it will be appreciated that the overall operation of the lock is substantially the same as other axial split-pin tumbler-type locks of the prior art, with the exception of the improvements as defined herein.

Figure 5:
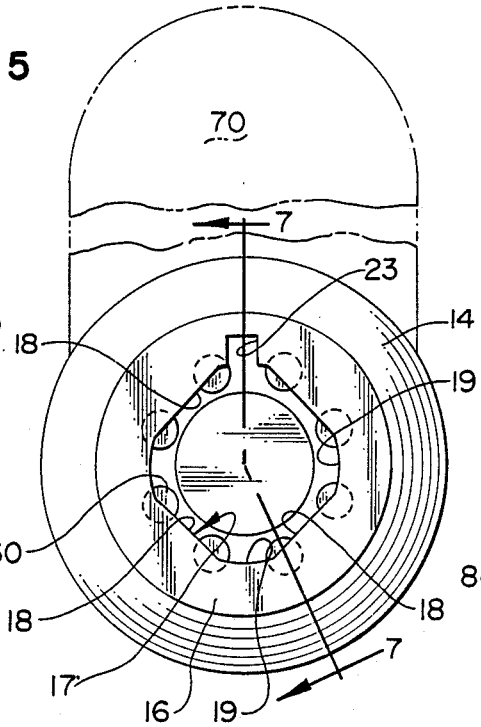
FIG. 5 is a front elevational view of the axial split pin tumbler type lock assembly of the present invention showing the manner in which the driver tumblers ride under the front face and alternatively riding under the thickened sections of the front face vis-a-vis the thinner sections of the front face.
Figure 6:
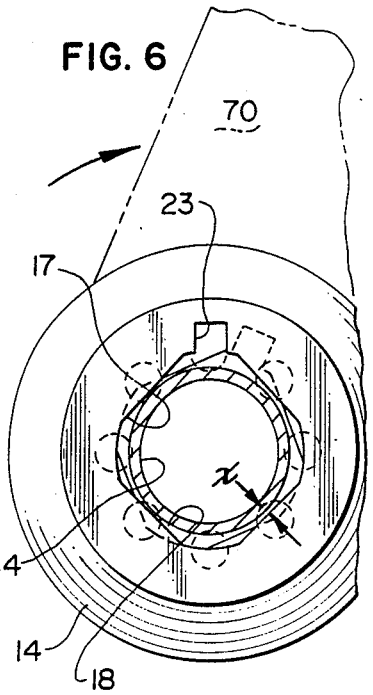
FIG. 6 is a front elevational view, in cross-section, illustrating the relative difference in surface area of the driver tumblers presented as the rotating part of the lock plug assembly is rotated due to the alternating thickened and thinner sections of the front face.

As further shown in FIGS. 2, 5, and 6 of the drawings, the inner surface 25 of the front face 16 provides a tumbler ledge 27 against which the driver tumblers 60 will ride when fully assembled. Due to the square-shaped configuration of the keyhole 17 and as was described previously, the front face 16 of the head 14 includes a series of four thickened sections 18 and four thinner sections 19. As shown in FIG. 5, in the lock's rest position, the driver tumblers 60 have a portion of the heads thereof exposed through the square-shaped keyhole 17. This represents the portion of the head of the driver tumblers 60 which are exposed to the bittings 89 of the key 80 as the key 80 is inserted in the keyhole 17. As is commonly known, once the key 80 is properly inserted in the lock 10 and the respective tumblers 60 and 65 are moved to the shear line 95 of the lock, the rotating part of the lock may be turned which will generally manipulate the locking bolt 70 into its unlocked position, or alternatively, to its locked position. However, as illustrated in FIG. 6 of the drawings, due to the square-shaped configuration of the keyhole 17 which includes the thickened sections 18, the surface area of the driver tumblers 60 exposed to the open keyhole 17 (represented by the letter X in FIG. 6) is less than the surface area of the drive tumblers 60 exposed when the tumbler 60 rides under the thinner section 19. Hence, if one attempts to insert a picking tool into the lock when in its rest position (see FIG. 5), a smaller portion of the surface area of the tumbler head 60 is exposed to the picking tool rendering the operation of the picking tool much more difficult. The only area in which a greater portion of the surface area of the tumbler is exposed through the keyhole 17 is when the tumblers are moved and ride under the thinner section 19 of the front face 16. The respective positions of the tumblers as the same ride along the tumbler ledge 27 are depicted in FIGS. 5 and 6 of the drawings. This construction renders the ability to pick the lock far more resistant and/or time consuming than the standard axial split pin tumbler locks presently available.

In other words, as described previously, by providing the keyhole with a square-shaped configuration as illustrated at 17, and further providing the cylindrical head 40 with a square-shaped cut-out section 45 which accommodates a key having a key seat 85 which has an outer square-shaped configuration with an inner cylindrical core, only a square-shaped key will fit within the keyhole 17. Furthermore, since the front face 16 is provided with a series of four thickened sections 18 and four thinner sections 19, as the driver tumblers 60 rotate due to the rotation of the rotatable part of the lock consisting of the cylindrical head 40 and lock shaft 32, the tumblers will pass under the thickened sections and hence, less of the surface area of the tumbler heads 60 is presented to the keyway. By lessening the surface area of tumbler presented to the keyway, the ability to use a standard picking tool in order to pick such a lock renders the operation far more difficult since a picking tool will have less of a surface area to operate against. In the alternative, even if a picking tool were developed, the picking operation would be far more time consuming and hence, result in an increased pick resistant lock.

Another advantage derived from the present invention relates to the manufacturing process by which the lock of the present invention may be manufactured and produced. More specifically, as was indicated previously, the lock assembly 10 of the present invention includes the square-shaped keyhole 17. Further, it was indicated that a slot is positioned in the interior cylindrical wall of the lock cylinder 12 which matingly engages the orienting flange 56 formed on the outer surface of the sleeve member 50. It has been found that during the broaching process pursuant to which the square-shaped keyhole is cut into the lock cylinder 12, the slot formed in the interior cylindrical wall of the lock cylinder 12 may be formed simultaneously. In prior art axial split-pin tumbler-type locks, the keyhole is generally cylindrical in shape, while the slot is a more rectangular constructed element. It has been found that the broaching operation used to cut the square-shaped keyhole of the present lock, may work simultaneously to move into the interior wall of the lock cylinder and cut the slot in which the orienting flange 56 is positioned incident to the assembly process. The advantage achieved by this feature is that the orienting slot which matingly engages the orienting flange 56 will now be positioned in proper alignment relative to the square-shaped keyhole in virtually all instances and in connection which each and every lock so produced. Hence, incident to the assembly process, the sleeve member 50 will always be properly oriented relative to the cylindrical head 40, and lock cylinder 12. In this manner, the respective tumbler bores 42 of the cylindrical head 40 and the tumbler bores 54 of the sleeve member 50 will always be properly aligned such that the respective tumbler 60 and 65 will similarly be properly aligned and eliminate the possibility of defective locks being produced incident to the manufacturing process. Hence, the constructional features of the present invention permit a reduction in the steps of the manufacturing process, and more accurately position the respective lock parts in order to create a lock which may be mass produced and eliminate locks which have improperly aligned and oriented parts.

From the foregoing description, it will be appreciated that the present invention provides an improved axial split-pin tumbler-type lock which is constructed in a manner to enhance the pick resistance thereof. More specifically, the axial split-pin tumbler-type lock of the present invention employs the use of a square-shaped key-hole, formed in the front face of the lock, which corresponds with and is positioned adjacent to a cylindrical head portion of the plug assembly which also is provided with a square-shaped cut-out section. The tumblers which are located in the cylindrical head, ride on a tumbler ledge under the front face of the lock which presents a keyhole face which alternates between presenting thickened sections of the front face alternating with the thinner sections thereof. The key is similarly square shaped in its outer dimensions, and includes a central circular core which corresponds with the cylindrical configuration of the guide post of the lock shaft. The key includes a square-shaped key seat in which are positioned the grooves and bittings which correspond and matingly engage the driver tumblers located in the cylindrical head. Due to the square-shaped configuration of the front face, and the provision of alternating thickened sections, alternating with thinner sections in the front face, the actual surface area of the driver tumbler heads exposed to the keyway is greatly reduced when the tumblers ride under the thickened section of the front face. Hence, only a properly bitted key inserted in the key hole will engage the driver tumblers in order to manipulate and operate the lock. The use of a lock pick inserted through the front face of the keyhole are presented with a smaller surface area of driver tumbler head to work against, and hence, increases the level of difficulty in picking the lock. Hence, even while a greater portion of the surface area of the driver tumbler heads may be exposed as the same are positioned under the thinner section of the front face, once a lock pick is utilized to turn the rotatable part of the lock and hence, the driver tumblers will pass under the thickened section of the front face thereby decreasing the surface area of the tumbler head which presents a bearing surface for the lock pick. This process renders the use of the pick far more difficult, or in the alternative, far more time consuming, such that the operator of the pick will have a more difficult time in locating the shear plane of the lock.

Based upon the construction of the present invention, an improved more pick-resistant axial split-pin tumbler-type lock has been provided. While the present description describes what is at present considered to be the preferred embodiments of the invention. It will be understood that various modifications may be made therein and it is intended to cover in the appended claims all such modifications as fall within the true spirt and scope of the invention.

I claim:

1. In an axial split pin tumbler lock mechanism having increased pick resistant of the type including a lock cylinder, a barrel assembly secured within the lock cylinder and having a longitudinal axis extending between front and rear ends thereof, barrel assembly including a lock shaft having a forward and a rear end and a forwardly disposed operating part rotatable about the longitudinal axis formed by the lock shaft carrying a cylindrical head portion adjacent the forward end thereof, a stationary sleeve member carried on the lock shaft adjacent the rear end thereof and adjoining the cylindrical head portion at a transverse interfacial plane, a plurality of longitudinal bores formed in each of said cylindrical head portion and sleeve member, the bores being disposed radially around the longitudinal axis thereof and being relatively movable into and out of longitudinal alignment upon rotation of the operating part, tumbler means each including a forwardly disposed driver tumbler carried in the cylindrical head portion and a rearwardly disposed follower tumbler carried in the stationary sleeve member, the tumbler means being axially reciprocable to provide a rotationally movable position when the respective driver tumblers and follower tumblers coincide with the interfacial plane between the cylindrical head portion and the sleeve member, and a lock position when at least one of the tumblers bridges the interfacial plane, spring means carried in one set of the bores for yieldingly urging the tumblers in aligned bores into the lock position and the driver tumblers having front ends engagable with a key such that rearward movement of the key moves the tumblers in aligned bores rearwardly to positions wherein tumbler joints coincide with the interfacial plane, the improvement comprising in combination, said lock cylinder formed by a hollow cylinder body carrying a lock head at the forward end thereof and the hollow cylinder body adapted to carry the barrel assembly therein, said lock head provided with a substantially square shaped keyhole formed therein, said substantially square shaped keyhole defining a front face on said lock head which includes a series of thickened face sections alternating with a series of thinner face sections, and said keyhole defining an inner face defined by said substantially square-shaped keyhole, said inner face of said keyhole providing a tumbler ledge forming a riding surface for the front ends of said driver tumblers positioned within said cylindrical head portion whereby said driver tumblers ride in a path alternating between thickened sections and thinner sections of said tumbler ledge, said cylindrical head portions of said operating part having a forward end provided with a substantially square shaped cut-out section presented therein, said substantially square shaped cut-out section radially traversing the tumbler bores formed therein, said substantially square shaped cut-out section of said cylindrical head portion being in axial alignment with and disposed immediately rearward of said substantially square shaped keyhole formed in said lock head, and a tubular key having an inner circular core and an outer substantially square shaped face adapted to matingly engage within said substantially square shaped keyhole in said lock head and said substantially square shaped cut-out section in said cylindrical head portion, said outer substantially square shaped key face having bitted sections around the periphery thereof for engagement with corresponding driver tumblers located in said cylindrical head portion, whereby only a properly bitted key having an outer substantially square shaped face may be inserted in said substantially square shaped keyhole and into said substantially square shaped cylindrical head portion to manipulate the driver tumblers and operate said lock mechanism, said driver tumblers otherwise being at least partially shielded from manipulation by a lock pick by the thickened sections of said tumbler ledge.

2. The axial split pin tumbler lock mechanism as set forth in claim 1, wherein said lock head has an outer circular periphery, and said keyhole is substantially square shaped thereby to define a front face on said lock head which includes a series of thickened face sections alternating between a series of thinner face sections.

3. The axial split pin tumbler lock mechanism as set forth in claim 2 above, wherein said lock head of said lock cylinder further includes a key guide notch formed therein and traversing a portion of said keyhole defining the front face thereof, said cut-out section of said cylindrical head portion provided with a key guide notch formed therein and adapted to be positioned in axial alignment with said key guide notch formed in said lock head, and said key including a key guide flange extending upwardly therefrom which matingly engages with said key guide notches of said lock head and said cut-out section thereby to properly orient said key within said keyhole.

4. The axial split pin tumbler lock mechanism as set forth in claim 3 above, wherein said key guide notch in said lock head is positioned in one of said thinner face sections.

5. The axial split pin tumbler lock mechanism as set forth in claim 1 above, wherein said lock shaft is substantially circular in configuration and having a forward end extending forwardly of said cylindrical head portion and positioned centrally within the confines of said substantially square shaped keyhole and said lock head thereby to provide a bearing surface for the inner circular core of said tubular key.

6. The axial split pin tumbler lock mechanism as set forth in claim 1 above, wherein said lock cylinder further includes an elongate slot formed along a portion of the interior wall thereof, and said sleeve member is provided with an upstanding flange formed along the upper surface thereof, said flange adapted from mating engagement with said slot thereby to secure said sleeve member against rotational movement when positioned within said lock cylinder thereby to allow said operating part to rotate in response to manipulation by a proper key while said sleeve member remains fixed against rotation.

* * * * *